US005791525A

United States Patent [19]

Fan

[11] Patent Number: 5,791,525

[45] Date of Patent: Aug. 11, 1998

[54] LIQUID SOAP DISPENSER

[76] Inventor: Chen-yueh Fan, 3rd. Fl., No. 2, Alley 2, Lane 88, Sec. 2, Shuiyuan Rd., Hsichih Chen, Taipei Hsien, Taiwan

[21] Appl. No.: 783,877

[22] Filed: Jan. 16, 1997

[51] Int. Cl.[6] ..... B67D 5/06

[52] U.S. Cl. ..... 222/181.3; 222/183; 222/325

[58] Field of Search ..... 222/181.3, 181.2, 222/182, 183, 325

[56] References Cited

U.S. PATENT DOCUMENTS

| | | | |
|---|---|---|---|
| 3,747,809 | 7/1973 | Harvey et al. | 222/183 |
| 4,757,920 | 7/1988 | Harootian, Jr. et al. | 222/146.6 |
| 5,452,825 | 9/1995 | Comstock et al. | 222/135 |
| 5,597,093 | 1/1997 | Lee | 222/113 |

*Primary Examiner*—David J. Walczak
*Assistant Examiner*—Timothy L. Maust
*Attorney, Agent, or Firm*—Hedman, Gibson & Costigan, P.C.

[57] ABSTRACT

A liquid soap dispenser includes a base used to be attached to a wall of a public toilet. A clamping device is formed with the base for clamping two liquid soap receiving bottles equipped with liquid soap discharging controllers. When the controllers are pushed, a predetermined amount of liquid soap will flow out of the bottles. A mounting portion is integrally formed along a top of the base and defines two lugs at two sides thereof and first inclined surfaces located just below and beside the lugs and second inclined surface located generally in front of the lugs. A cover defines a pair of mounting pins pivotably connected with the lugs and a pair of locating tabs. The cover is movable between a closed position and an opening position wherein in the closed position the locating tabs are located at a rear side of the mounting portion and when the cover is moved to the opening position the locating tabs are moved from the rear side of the mounting portion through the first inclined surfaces to engage with the second inclined surfaces to be retained thereon.

6 Claims, 5 Drawing Sheets

LIQUID SOAP DISPENSER

FIELD OF THE INVENTION

The present invention is related to a liquid soap dispenser, particularly to a liquid soap dispenser which is designed to be fixedly mounted on a wall of a public washroom.

BACKGROUND OF THE INVENTION

Solid soap is proven to be able to effectively achieve a cleaning of hands ect. However, it is not so convenient to be used since it needs time to be wetted to achieve a lather; furthermore, dirt may be adhered to the solid soap, which causes the solid soap to have an unpleasant appearance.

Thus, liquid soap is now more and more popularly used, particularly in a public washroom. Usually, the liquid soap is received in a bottle which is fixed on a wall of the public washroom by means of a mounting device. The bottle and the mounting device constitute a liquid soap dispenser. The mounting device generally comprises a base equipped with a clamping mechanism for clamping the bottle in place and a cover covering the bottle and the base. A liquid soap discharging controller is attached to a bottom of the bottle. When the controller is pushed, a predetermined amount of liquid soap is allowed to flow out of the bottle via an outlet.

Conventionally, when the bottle is empty, a user should use one hand to pivot, and, thus open the cover and then hold it in the opened position while using the other hand to remove the bottle from the base, whereby the empty bottle can be re-filled with liquid soap. However, it is difficult to use only a single hand to remove the bottle from the base.

The present invention therefore is aimed to provide a liquid soap dispenser to mitigate and/or obviate the aforementioned problems.

SUMMARY OF THE INVENTION

An objective of the present invention is to provide a liquid soap dispenser wherein a cover can be automatically maintained in an opened position, whereby a user can use both hands to remove a bottle from a base of the liquid soap dispenser.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
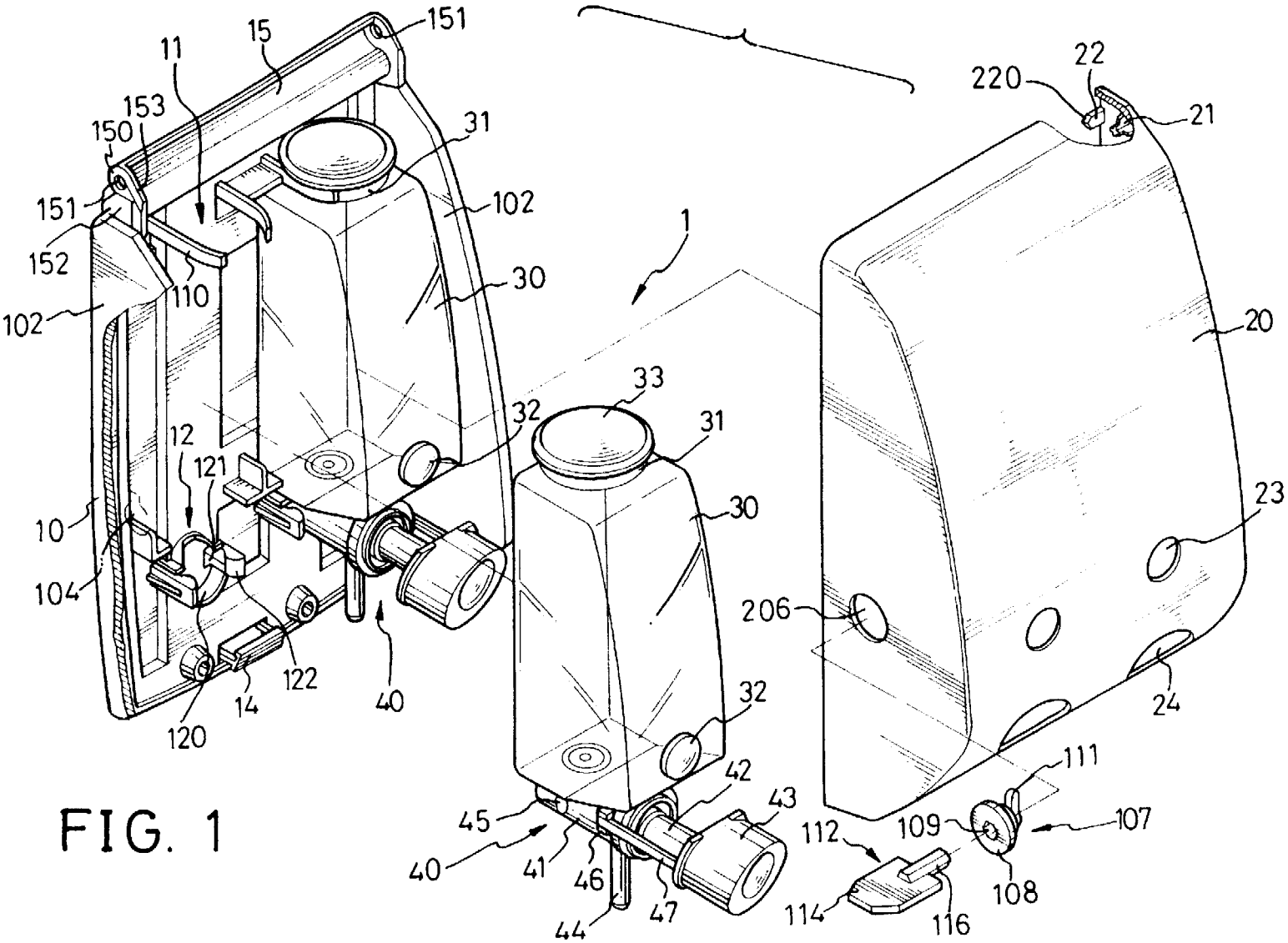
FIG. 1 is a left-front-top perspective, exploded view of a liquid soap dispenser in accordance with the present invention.
Figure 2:
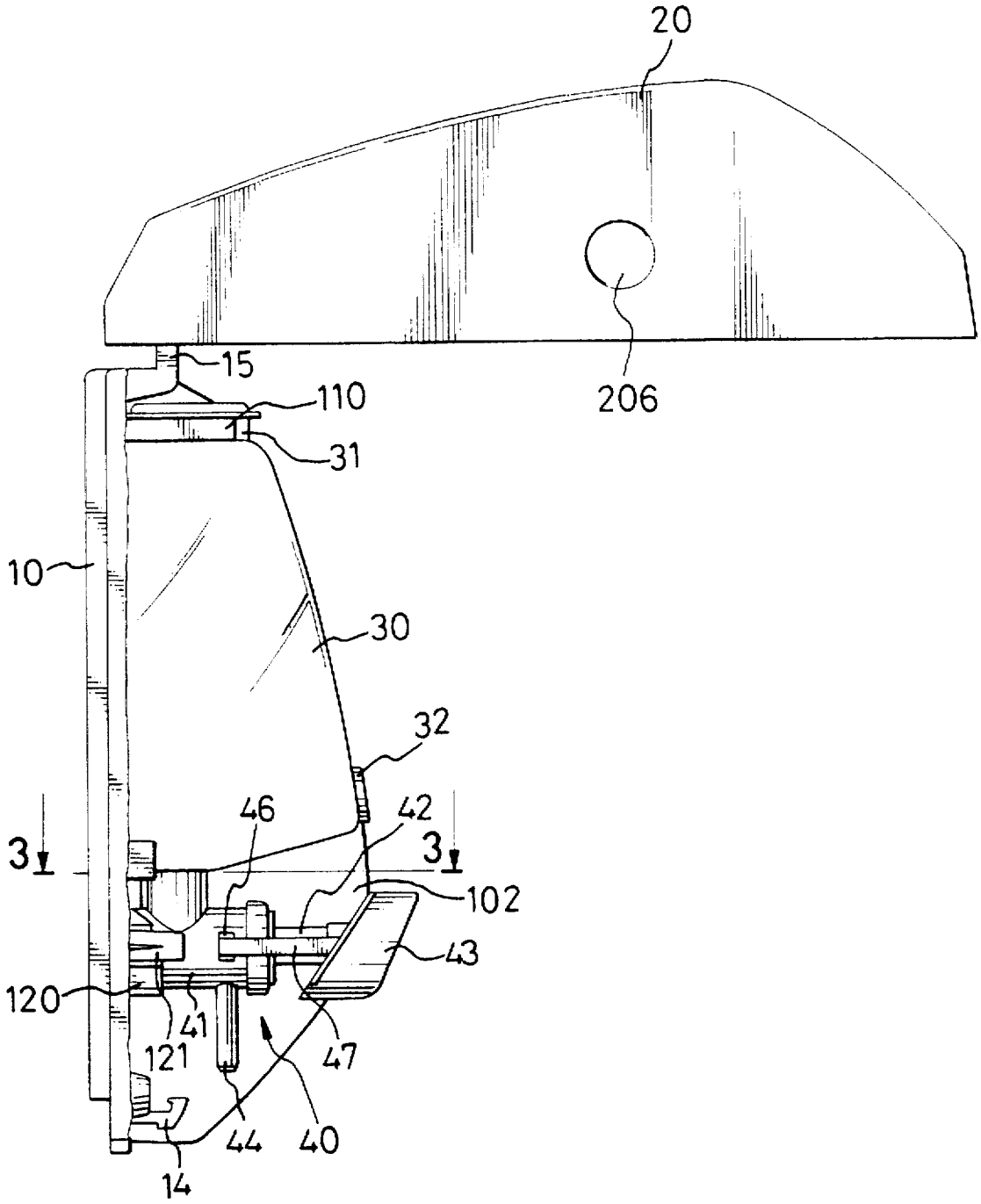
FIG. 2 is a side view of the liquid soap dispenser wherein a cover thereof is moved and held in an opened position.
Figure 3:
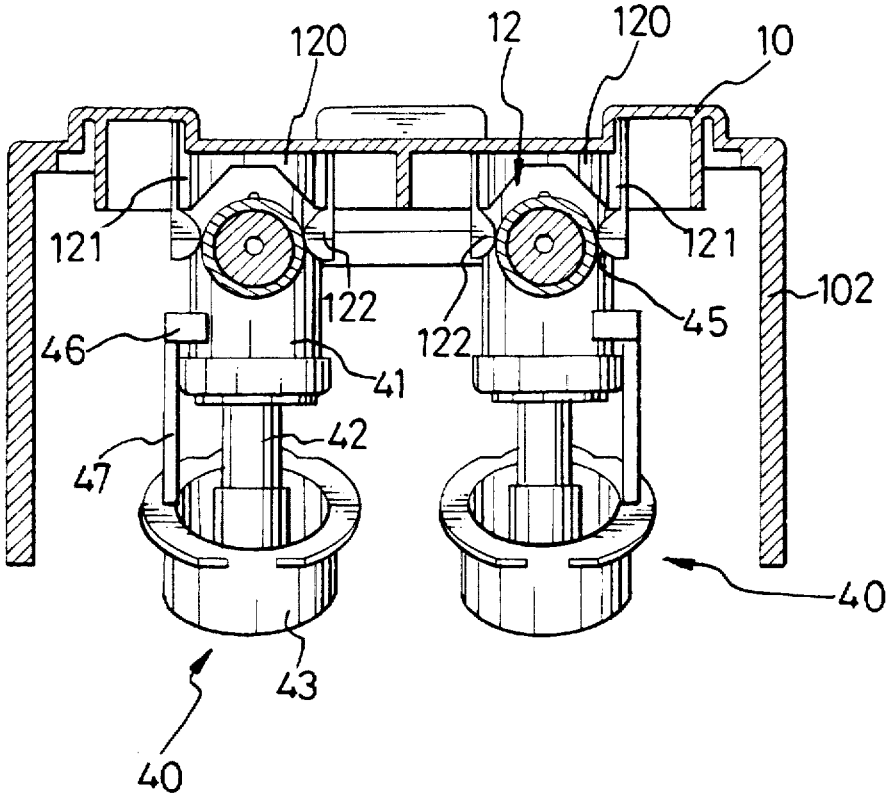
FIG. 3 is a cross-sectional view taken from line 3—3 of FIG. 2.

Referring to FIGS. 1 to 3, a liquid soap dispenser 1 includes a base 10 used tube fixedly attached to a wall of a public washroom by a known means, for example screwing or gluing, two bottles 30 for receiving liquid soap, two liquid soap discharging controllers 40 respectively provided on a bottom of the bottles 30, and a cover 20 pivotably connected to the base 10 about its top end. The base 10 includes a pair of side walls 102 extending forwardly from two lateral sides of the base 10. Here for clarity, the left side wall 102 in FIG. 1 has a front, lower portion being cut away, and a key hole 104 defined in the left side wall 102 is shown by phantom lines. In FIG. 2 only the right side wall 102 of FIG. 1 is shown.

Each bottle 30 comprises a neck 31 on a top thereof and a circular protrusion 32 on a front face thereof. A cap 33 is used to close a top opening of the bottle 30. Each bottle 30 is made of transparent plastic material.

Each liquid soap discharging controller 40 includes a cylinder 41 defining two opposite recesses 45 in a circumferential periphery thereof and a pair of projections 46 defining a guiding channel (not labeled) therebetween. A push bottom 43 is connected with a stem 42 extending into the cylinder 41 and a rod 47 fittingly extends through the projections 46, whereby, when the push button 43 is moved, it will only have a linear movement, without a rotation. The stem 42 is connected with a valve (not shown) inside the cylinder 41, whereby, when the push button 43 is pushed toward the cylinder 41, the valve is opened so that a predetermined amount of liquid soap is permitted to flow out of the bottle 30 via an outlet 44 extending downwardly from the cylinder 41. Since the valve in the liquid soap discharging controller 40 belongs to prior art and is not within the scope of the present invention, a detailed description thereof is omitted here.

A clamping device for clamping the two bottles 30 on the base 10 includes a pair of clamping assemblies. Each clamping assembly includes an upper clamp 11 and a lower clamp 12 wherein the upper clamp 11 includes a pair of upper clamping jaws 110 and the lower clamp 12 includes a pair of lower clamping jaws 121. The upper and lower clamping jaws 110 and 121 are integrally formed with the base 10. An arcuate supporting plate 120 is formed on the base 10 and located between and below the lower clamping jaws 121. Each lower clamping jaw 121 defines a clamping portion 122 for engaging with the cylinder 41.

When one of the bottles 30 is attached to the base 10, the neck 31 is engaged with the upper clamping jaws 110, a bottom face of the cylinder 41 is supported by the arcuate supporting plate 120 and two sides of the cylinder 41 are engaged with the lower clamping jaws 121 wherein the clamping portions 122 respectively extend into the two recesses 45.

The base 10 is further formed with two bottom hooks 14 (only one is shown), wherein the hooks 14 are used to engage with a bottom end of the cover 20 when the cover 20 is moved to a closed position.

The cover 20 is formed to have two small circular openings 23 in a front, lower side thereof and two large semicircular openings 24 below the small circular openings 23. Furthermore, the cover 20 is formed to have a pair of mounting pins 21 (only one is shown in FIG. 1) protruding from inner faces of two side walls of the cover 20 and two locating tabs 22 formed behind the mounting pins 21. Each locating tab 22 defines a triangular tip 220.

The base 10 is further formed with a cover mounting portion 15 laterally extending along a top of the base 10 and defining two lugs 150 on two sides thereof. Each lug 150 defines a mounting hole 151 for pivotably connecting a respective one of the mounting pins 21. Two first inclined surfaces 152 (only one is shown in FIG. 1) are formed respectively just below and beside the mounting holes 151. Two second inclined surfaces 153 (only one is shown in FIG. 1) are formed respectively generally in front of the mounting holes 151.

Figure 4:
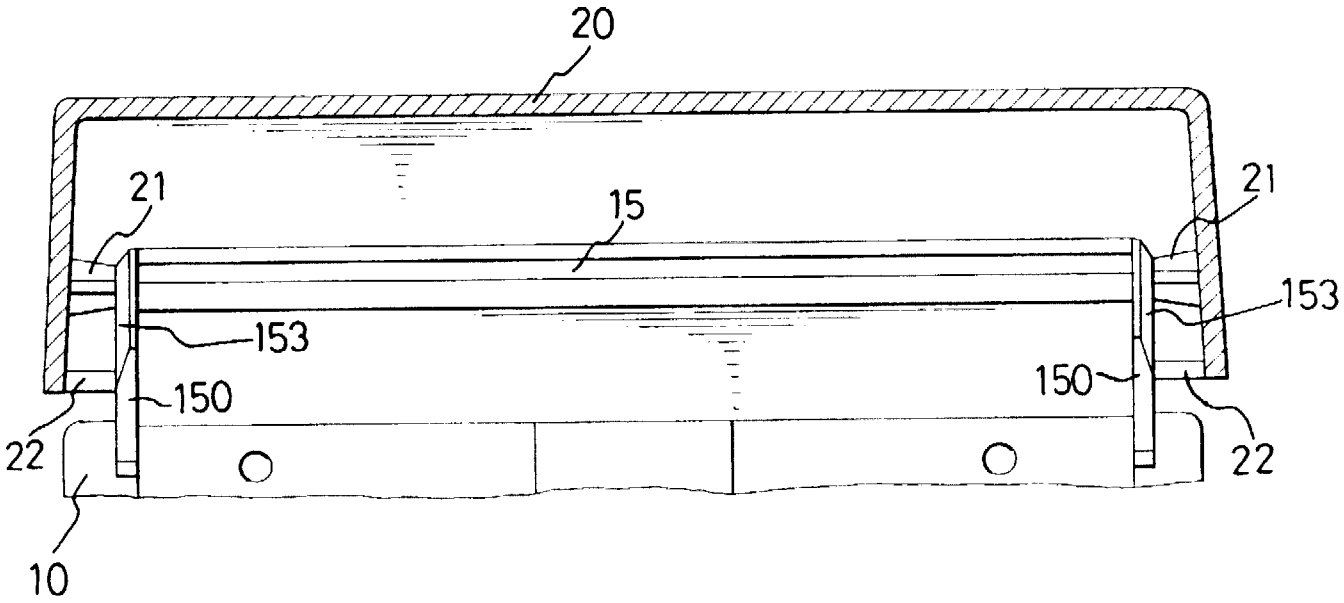
FIG. 4 is a front, partially cross-sectional view showing the relation between a base and the cover when the cover is in a closed position.

Also refer to FIG. 4, which shows that the cover 20 is mounted on the base 10 and located in a closed position wherein the bottom of the cover 20 is engaged with the hooks 14. In FIG. 4, it can be seen that the pins 21 pivotably connect with the cover mounting portion 15 and the locating tabs 22 are located behind the mounting portion 15. In this closed position, the protrusions 32 on the bottles 30 are fitted within the small circular openings 23. By the provision of the protrusions 32, the user can check the amount of the liquid soap in the bottles 30 to decide whether the bottles need to be re-filled with liquid soap. Furthermore, in this closed position, the push buttons 43 project from the large semicircular openings 24, whereby the user can operate the liquid soap discharging controllers 40 to make the liquid soap to flow out of the bottles 30.

Figure 5:
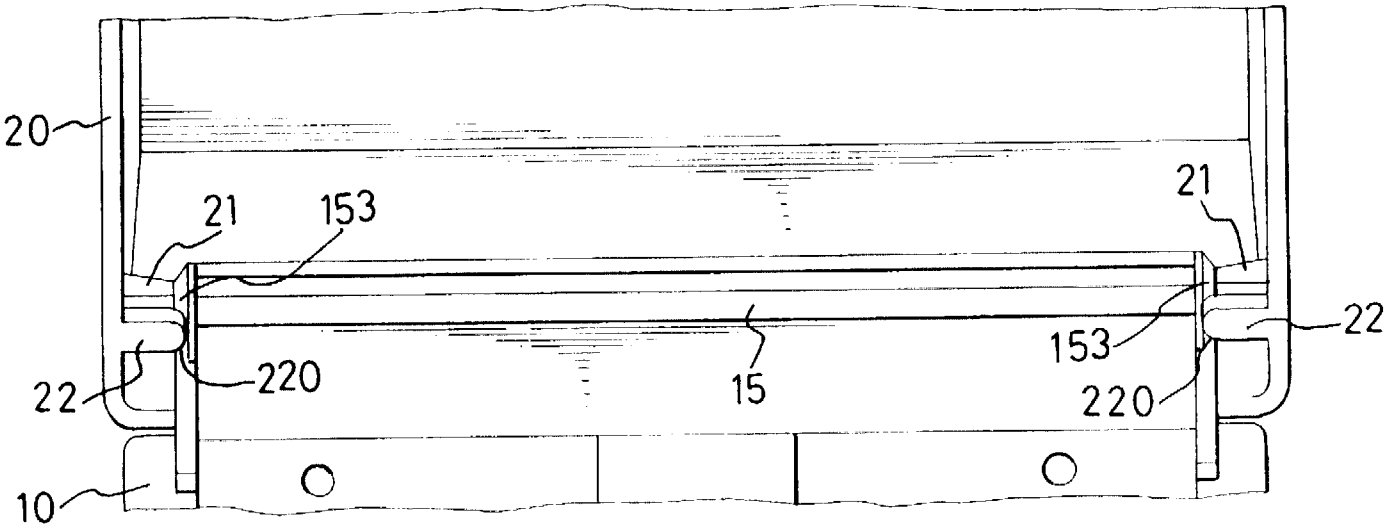
FIG. 5 is a view as seen from a front, bottom side of the liquid soap dispenser showing the relation between the base and the cover when the cover is in an opened position.

Also refer to FIG. 5, which shows that the cover 20 is moved to a fully-opened position as shown by FIG. 3 in which the cover 20 is generally perpendicular to the base 10. When the cover 20 is moved from the closed position of FIG. 4 to the fully-opened position, the locating tabs 22 are respectively rotated in a counterclockwise direction as viewed from the left side of FIG. 1 from the rear side of the mounting portion 15 via the first inclined surfaces 152 to reach the second inclined surfaces 153 in which the triangular tips 220 of the locating tabs 22 are respectively engaged with and retained by the second inclined surfaces 153 so that the cover 20 is automatically held in this opened position, whereby the user can use both of his (her) hands to manipulate the clamping device to remove the bottles 30 from the base 10.

Particularly referring to FIG. 1, the left one of the side walls 102 of the base 10 is provided with the key hole 104 which, when the cover 20 is in the closed position, is aligned with a hole 206 defined in the left side wall of the cover 20. A locking member 107 defines a head 108 with a hexagonal recess 109 and a locking tongue 111. The head 108 has a diameter larger than that of the hole 206. A key 112 defines a handle 114 and a hexagonal stud 116. The cover 20 can be locked to the base 10 in the closed position by the following operations. Firstly, a right portion of the locking member 107 beside the head 108 is brought to extend through the hole 206 to reach a position that the head 108 closely abuts an outer face of the left side wall of the cover 20 and the locking tongue 111 is passed through the key hole 104. Then, the stud 116 is brought to matingly extend into the recess 109 and the key 112 is turned about 90° by which the locking member 107 is turned accordingly and the locking tongue 111 is tightly engaged with an inner face of the left side wall 102 whereby the left side walls of the base and the cover are locked together by the locking member 107. Finally, the key 112 is removed from the locking member 107. Since the design of the key 112, the hole 206, the key hole 104 and the locking member 107 belong to prior art and are not within the scope of the present invention, a detailed description thereof is omitted. Locking the cover 20 in the closed position can prevent an unauthorized person from tampering with the content of the bottle 30.

I claim:

1. A liquid soap dispenser, comprises:

a base (10) used to be fixedly attached to a wall, said base (10) comprising:

a clamping device integrally formed with the base (10), said clamping device comprising at least an upper clamp (11) and at least a lower clamp (12);

at least one arcuate supporting plate (120) integrally formed with the base (10) and located below and between the lower clamp (12); and a cover mounting portion (15) laterally formed along a top of the base and defining two lugs (150) respectively on two sides thereof, each lug (150) defining a mounting hole (151) and said cover mounting portion (15) further defining two first inclined surfaces (152) respectively located just below and beside the mounting holes (151) and two second inclined surfaces (153) located respectively generally in front of the mounting holes (151);

at least one bottle (30) for receiving liquid soap, the bottle (30) defining a neck (31) engaging with the upper clamp (11);

at least one liquid soap discharging controller (40) provided in a bottom of the bottle (30), said controller (40) engaging with the lower clamp (12) and supported by the supporting plate (120), when the controller (40) is pushed, a predetermined amount of liquid soap will flow out of the bottle (30);

a cover (20) attached to the base (10) and movable between a closed position and an open position, said cover (20) defining a front wall, two side walls, two mounting pins (21) projecting inwardly respectively from inner faces of the two side walls and two locating tabs (22) located respectively behind the mounting pins (21), said mounting pins (21) pivotably engaging respectively with the mounting holes (151) defined in the mounting portion (15), whereby when the cover (20) is in a closed position, the cover (20) covers the bottle and the clamping device and the locating tabs (22) are located in a rear side of the mounting portion (15), and when the cover (20) is moved from the closed position to the open position in which the cover (20) is substantially perpendicular to the base, the locating tabs (22) are moved from the rear side of the mounting portion (15) through the first inclined surfaces (152) to engage with the second inclined surfaces (153) and are retained thereon.

2. A liquid soap dispenser in accordance with claim 1, wherein the bottle (30) is made of transparent plastics material and has a front side defining a circular protrusion (32) and the cover (20) defines at least one circular opening (23) and wherein when the cover (20) is in the closed position, said protrusion (32) is fitted within the circular opening (23) whereby a user can check the amount of liquid soap in the bottle (30) through the protrusion (32).

3. A liquid soap dispenser in accordance with claim 1, wherein the liquid soap discharging controller (40) comprises a cylinder (41) supported by the supporting plate (120) and defining two opposite recesses (45) engaging with the lower clamp (12) and a pair of projections (46) defining a guiding channel therebetween, a stem (42) having a first end extending into the cylinder (41) to operably connect with a valve and a second end, a push button (43) fixedly connected with the second end of the stem (42), a rod (47) having a first end fixedly connected with the push button (43) and a second end fittingly extending through the projections (46), and an outlet (44) extending downwardly from the cylinder (41), whereby when the push button (43)

is pushed, a predetermined amount of liquid soap will flow out of the bottle (30).

4. A liquid soap dispenser in accordance with claim 1, wherein the base (10) is further formed with at least one hook (14) at a bottom thereof, said hook (14) engaging with a bottom of the cover (20) when the cover (20) is in the closed position.

5. A liquid soap dispenser in accordance with claim 3, wherein the cover (20) is further formed with at least one semicircular opening (24) below the circular opening (23) and the push button (43) is extended through the semicircular opening (24).

6. A liquid soap dispenser in accordance with claim 1, wherein each of the locating tabs (22) defines a triangular tip (220).

* * * * *